M7219 XR 4,166,500

United States Patent [19]

McPhee

[11] 4,166,500

[45] Sep. 4, 1979

[54] WELL LOGGING METHOD AND APPARATUS USING FRICTION-REDUCING AGENTS

[75] Inventor: William A. McPhee, Houston, Tex.

[73] Assignee: Dresser Industries, Inc., Dallas, Tex.

[21] Appl. No.: 839,136

[22] Filed: Oct. 3, 1977

[51] Int. Cl.[2] ..... E21B 47/00; E21B 47/12

[52] U.S. Cl. ..... 166/250; 137/13; 73/151; 73/152; 166/65 R; 166/66; 166/72; 166/169

[58] Field of Search ..... 166/250, 253, 254, 255, 166/53, 64, 65 R, 66, 72, 169; 250/253, 254, 256; 137/13; 324/1, 2, 11; 73/151; 175/40, 42, 50

[56] References Cited

U.S. PATENT DOCUMENTS

| | | | |
|---|---|---|---|
| 2,659,046 | 11/1953 | Arps | 175/40 X |
| 2,996,619 | 8/1961 | Herzog | 250/254 |
| 3,230,919 | 1/1966 | Crawford | 137/13 X |
| 3,290,883 | 12/1966 | Giles et al. | 137/13 X |
| 3,929,088 | 12/1975 | Du Brow et al. | 137/13 X |
| 3,938,536 | 2/1976 | Metzner et al. | 137/13 |

OTHER PUBLICATIONS

Rogers, "Composition and Properties of Oil Well Drilling Fluids", 1st Edition, Gulf Pub. Co., Houston, Texas, 1948, pp. 6 and 7.

Union Carbide (pamphlet F-43273) "Using Polyox® Water-Soluble Resins to Reduce Hydrodynamic Drag", Union Carbide Corp., 270 Park Ave., New York, N.Y., 3-1971, 15 pages.

*Primary Examiner*—Stephen J. Novosad

*Attorney, Agent, or Firm*—Albert M. Crowder, Jr.

[57] ABSTRACT

A well logging instrument has a fluid chamber at its lower end and a plurality of controlled flow orifices leading from the chamber to the exterior of the instrument. A piston within the chamber, having a spring at its upper end, forces a friction-reduction agent from the chamber through the flow-controlled orifices into the earth borehole to facilitate the movement of the well logging instrument through the borehole. The upper portion of the fluid chamber, above the piston, is also ported to the fluid within the borehole to equalize the pressure across the piston. In an alternative embodiment of the invention, the acceleration of the borehole instrument creates a velocity signal which is compared with the velocity of the logging cable at the earth's surface and upon a sufficient difference in velocity, the friction-reduction agent is caused to be ported into the earth borehole.

8 Claims, 6 Drawing Figures

WELL LOGGING METHOD AND APPARATUS USING FRICTION-REDUCING AGENTS

BACKGROUND OF THE INVENTION

This invention relates generally to an apparatus for logging earth boreholes and specifically to an apparatus which utilizes means to assist a well logging instrument to traverse highly deviated earth boreholes.

It has become relatively common within the last few years to drill wells in the search for oil and gas and the like with a portion of the well bore deviating from the usual vertical orientation thereof. The deviation or inclination may extend for a considerable distance at angles ranging to 70°, sometimes returning to the usual vertical orientation.

It is also well known in the art of drilling such wells to attempt the logging of the formations surrounding such boreholes with logging instrument run into the well bore on a wire-line and/or a cable to perform various operations. Such tools usually depend upon the force of gravity to permit positioning of the well tool at the desired location in the well bore.

Another problem associated with such boreholes relates to the instability of some formations penetrated by the well bore, thus causing borehole diameter changes, some very abrupt. Ledges are formed, and the logging instrument frequently will lodge against them.

It is therefore the primary object of the present invention to provide new and improved methods and apparatus for logging earth boreholes, especially those boreholes having abrupt ledges therein.

The objects of the invention are accomplished, generally, by methods and apparatus which utilize means for porting a fluid-reduction agent into the earth borehole to facilitate the movement of the well logging instrument through the borehole. In one embodiment of the invention, a fluid-reduction agent is continually injected into the borehole. In another embodiment, the fluid-reduction agent is ported into the borehole upon some change in conditions, for example, such as a reduction in the velocity of the well logging instrument, or by a manual command from the earth's surface.

These and other objects, features and advantages of the present invention will be apparent from the following detailed description taken with reference to the figures of the accompanying drawing, wherein:

FIG. 1 is a schematic view illustrating the drilling of a deviated earth borehole from an offshore platform;

FIG. 2 schematically illustrates a prior art well logging system encountering some of the problems associated with logging a highly deviated earth borehole;

Figure 1:
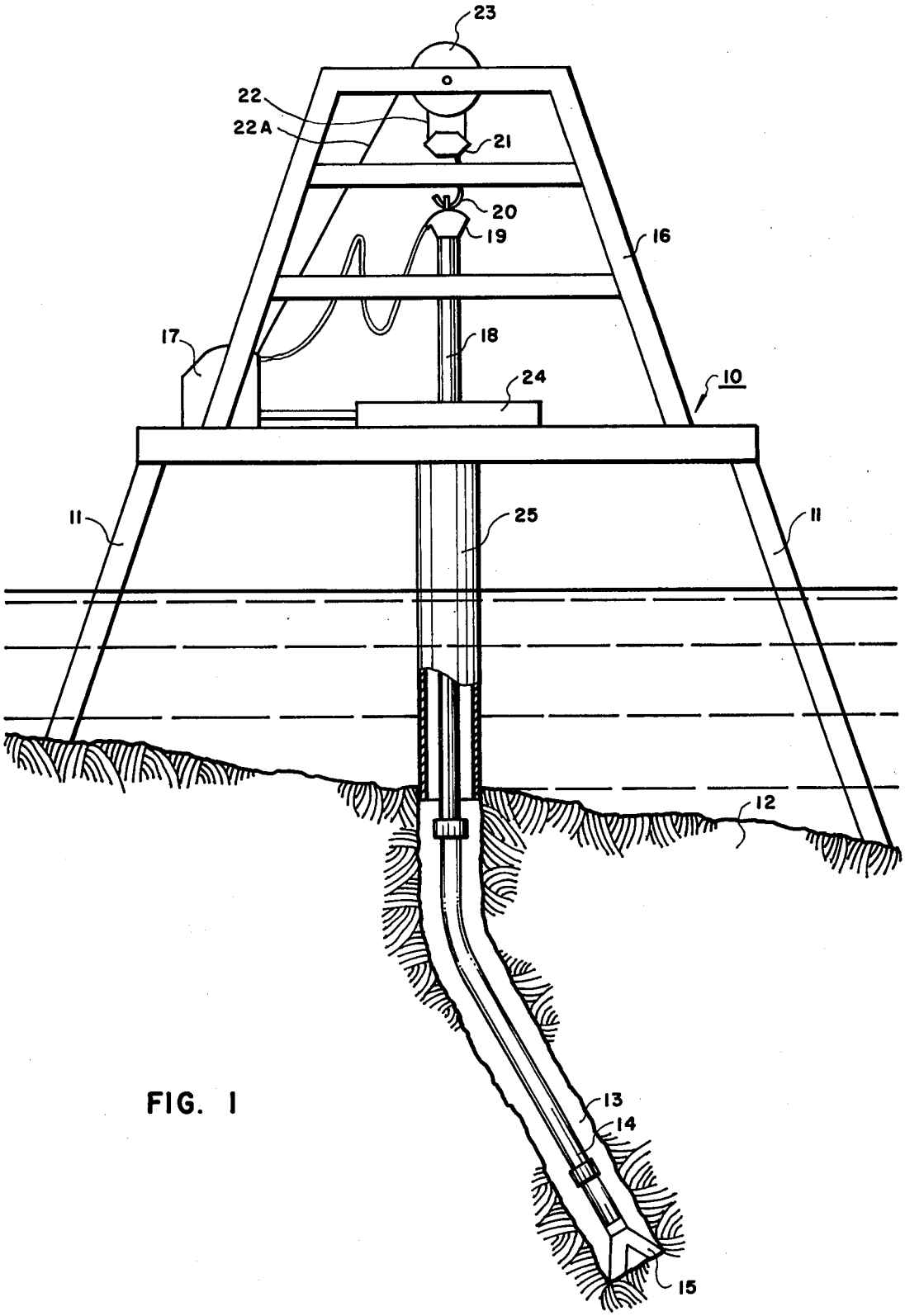

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks 17 also drive a rotary table 24 which in turn transmits the drive to the kelly 18. One end of the line 22, namely the fast line **22*a*, is connected to the drawworks 17 which contains the motor or motors for manipulating the drill string. Although not illustrated, the other end of the drill line 22** is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
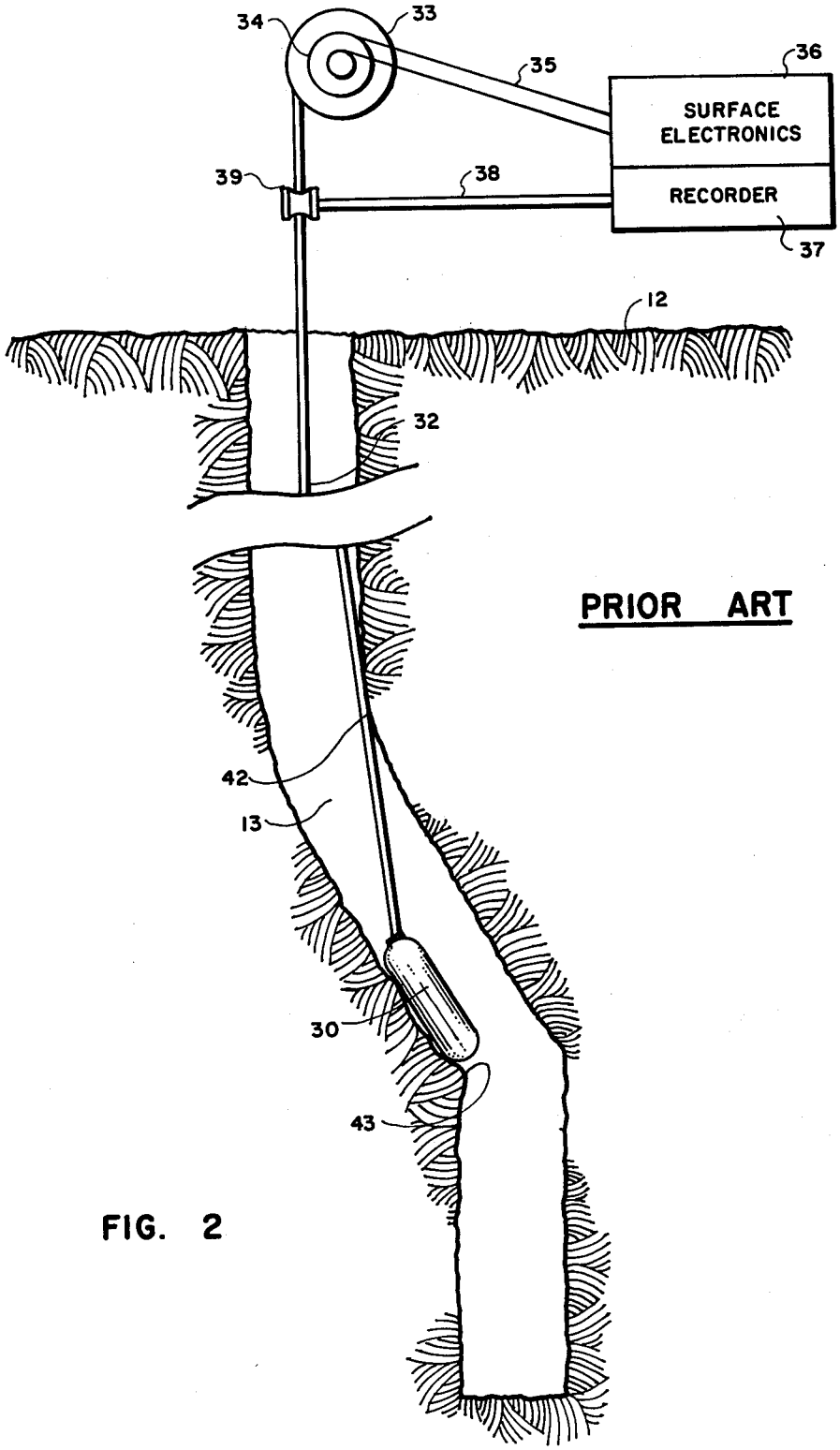

Referring now to FIG. 2, there is illustrated schematically a well logging operation conducted in accordance with the prior art in which a portion of the earth's surface 12 is shown in vertical section. A well 13, which has been drilled as illustrated in FIG. 1, penetrates the earth's surface. Disposed within the well is subsurface instrument 30 of the well logging system. The subsurface instrument 30 may be of any conventional type, for example, one which is adapted to conduct an induction, electric, acoustic, or any other of the conventional logs well known in the art. It should be appreciated, moreover, that the particular type of well logging instrument 30 forms no part of the present invention.

Cable 32 suspends the instrument 30 in the well and contains the required conductors for electrically connecting the instrument 30 with the surface electronics. The cable is wound on or unwound from drum 33 in raising and lowering the instrument 30 to traverse the well. During the traversal, the signals from the well logging instrument 30 are sent up the cable 32. Through slip rings and brushes 34 on the end of the drum 33, the signals are conducted by the lines 35 to the surface electronics 36. A recorder 37 connected to the surface electronics 36 is driven through the transmission 38 by the measuring reel 39 over which the cable 32 is drawn, so that the recorder 37 associated with the surface electronics 36 moves in correlation with depth as instrument 30 traverses the well. It is also to be understood that instruments such as the instrument 30 are generally constructed to withstand the pressures and mechanical and thermal abuses encountered in logging a deep well.

In the operation of the system illustrated in FIG. 2, the cable 32 is touching one ledge of the formation at the point 42 and the instrument 30 has come to rest against another such ledge at the point 43, the ledge 43 making it exceedingly difficult, if not impossible, for the instrument 30 to traverse the earth borehole merely by its own weight due to the force of gravity.

Figure 3:
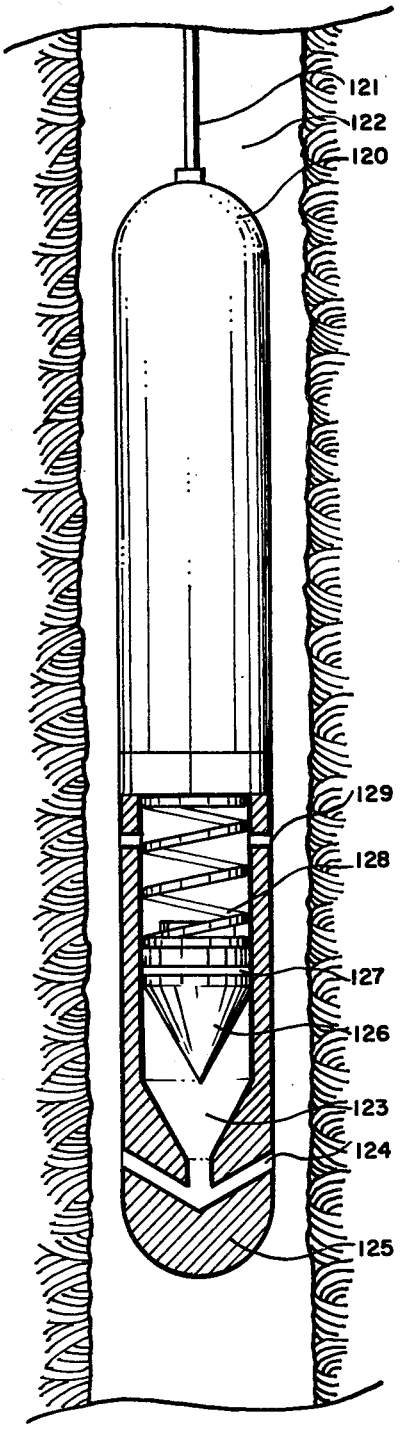
FIG. 3 is an elevated view, partly in cross section, of the apparatus according to the present invention for logging an earth borehole.

Referring now to FIG. 3, there is illustrated a well logging apparatus 120 which is suspended within the earth borehole 122 by the logging cable 121. The upper section of the apparatus 120 can contain any conventional well logging instrumentation, for example, those which are adapted to conduct an induction, electric, acoustic, or any other of the conventional logs well knwon in the art. It should be appreciated, moreover, that the particular type of well logging instrumentation within the apparatus 120 forms no part of the present invention.

The lower part of the apparatus 120 has an elongated body 125 through which a central fluid chamber 123 is formed and having a plurality of controlled flow orifices 124. Although two such flow orifices 124 are illustrated in FIG. 3, it should be appreciated that there can be any number of such flow orifices or ports 124, for example, four, six, eight or any other number so desired.

A piston 126 having a sealing member 127, for example, an O-ring, is slidably movable within the interior of the chamber 123. A spring 128 which is anchored to the upper portion of the chamber 123 pushes against the top part of the piston 126. One or more ports 129 connect the interior of the uppermost portion of the chamber 123 with the borehole 122 to provide pressure equalization across the piston 126. The lower part of the chamber 123 is filled with a friction-reduction agent to reduce drag within the highly deviated or tight borehole. For example, the fluid within the lower part of the chamber 123 can be comprised of a neutral polymer of high molecular weight, for example, POLYOX, which is produced by the Union Carbide Company. Other such friction reducers can be utilized, but the preferred embodiment contemplates the use of such a polymer in alcohol or glycol dispersion. The spring 128 is preferably set to maintain approximately 20–50 psi upon the fluid within the chamber 123 to force it out through the controlled orifices 124.

Quite obviously, the orifices 124 should preferably be plugged prior to the apparatus 120 being run into the borehole, for example, by placing a sleeve (not illustrated) over the lower end of the apparatus 120 to prevent the fluid from being forced prematurely out through the ports 124.

In the operation of the apparatus illustrated in FIG. 3, as the well logging instrument 120 is traversing the earth borehole 122, the spring 128 causes the piston 126 to push against the friction-reduction agent within the chamber 123 and out through the ports 124 into the earth borehole. The Applicant has discovered that the friction-reduction agents, when mixed in a liquid stream, can create reductions in drag in the magnitude of 80%. Thus, when the instrument comes to ledges such as that illustrated in FIG. 2, the friction-reduction agent helps to facilitate the movement of the instrument 120 past such ledges. In addition, the fluid can be introduced at the lubricator and also around the rope socket to reduce line drag.

Figure 4:
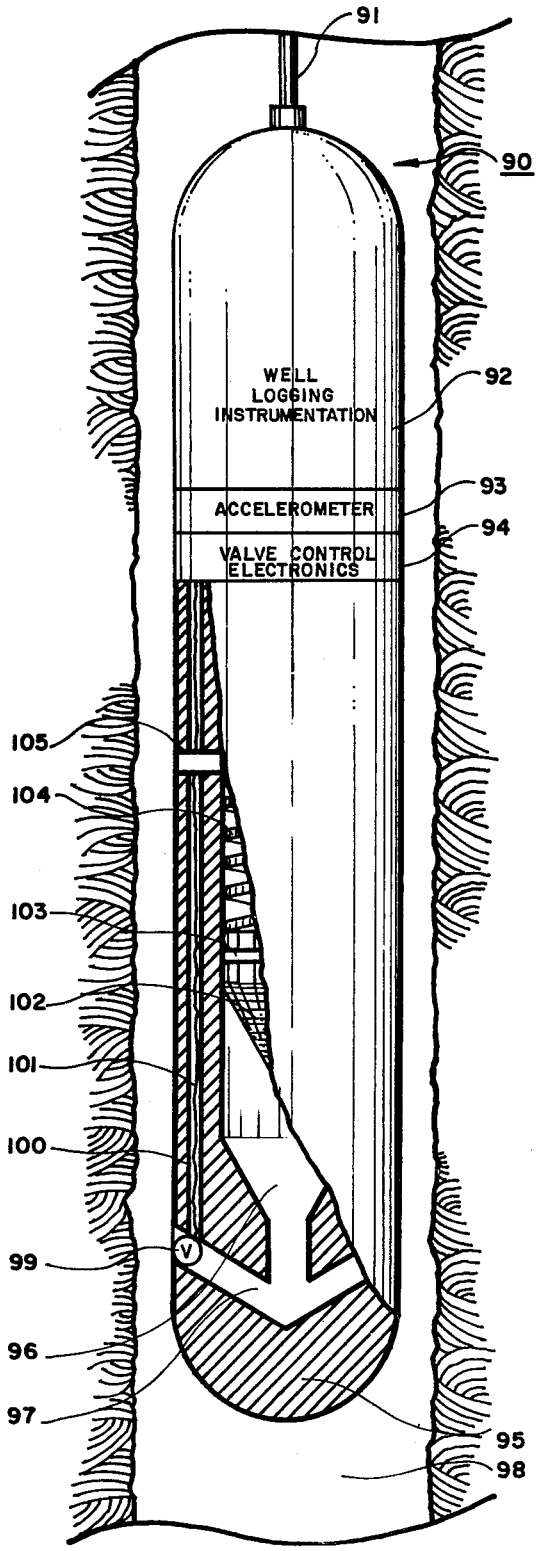
FIG. 4 is an elevated view, partly in cross section, of an apparatus according to an alternative embodiment of the present invention.

Referring now to FIG. 4, there is illustrated a well logging instrument 90 which is suspended within the earth borehole 98 by means of a well logging cable 91. The well logging instrument 90 includes an upper well logging instrumentation section 92 which may be of any conventional type. The instrument also contains an accelerometer 93 and a valve control electronics section 94. The valve control electronics section is connected by means of one or more wires 101 through a conduit 100 to a valve 99 which is located within the orifice 97 within the body 95 of the lower section of the well logging apparatus 90. As was illustrated in the apparatus of FIG. 3, the apparatus of FIG. 4 includes a fluid chamber 96 within which a friction-reduction agent is located. The chamber 96 contains a piston 102 having an O-ring or other sealing member 103. The piston 102 is forced against the fluid within the chamber 96 by means of a spring 104. A pressure equalizing port 105 maintains the upper portion of the chamber 96 in contact with the pressurized fluid within the borehole 98.

In the operation of the apparatus illustrated in FIG. 4, as the well logging instrument 90 traverses the earth borehole 98, upon a command from the valve control electronics section 94, the valve 99 is actuated and the friction-reduction agent within the chamber 96 beneath the piston 102 is ported into the borehole to reduce the friction around the well logging instrument 90. The action of the valve control electronics 94 will be more readily appreciated from the descriptions hereinafter relating to FIGS. 5 and 6. It should be understood, however, that the embodiment of FIG. 4 contemplates that the friction-reduction agent is ported into the borehole through the valve 99 only upon a command from the valve control electronics section 94.

Figure 5:
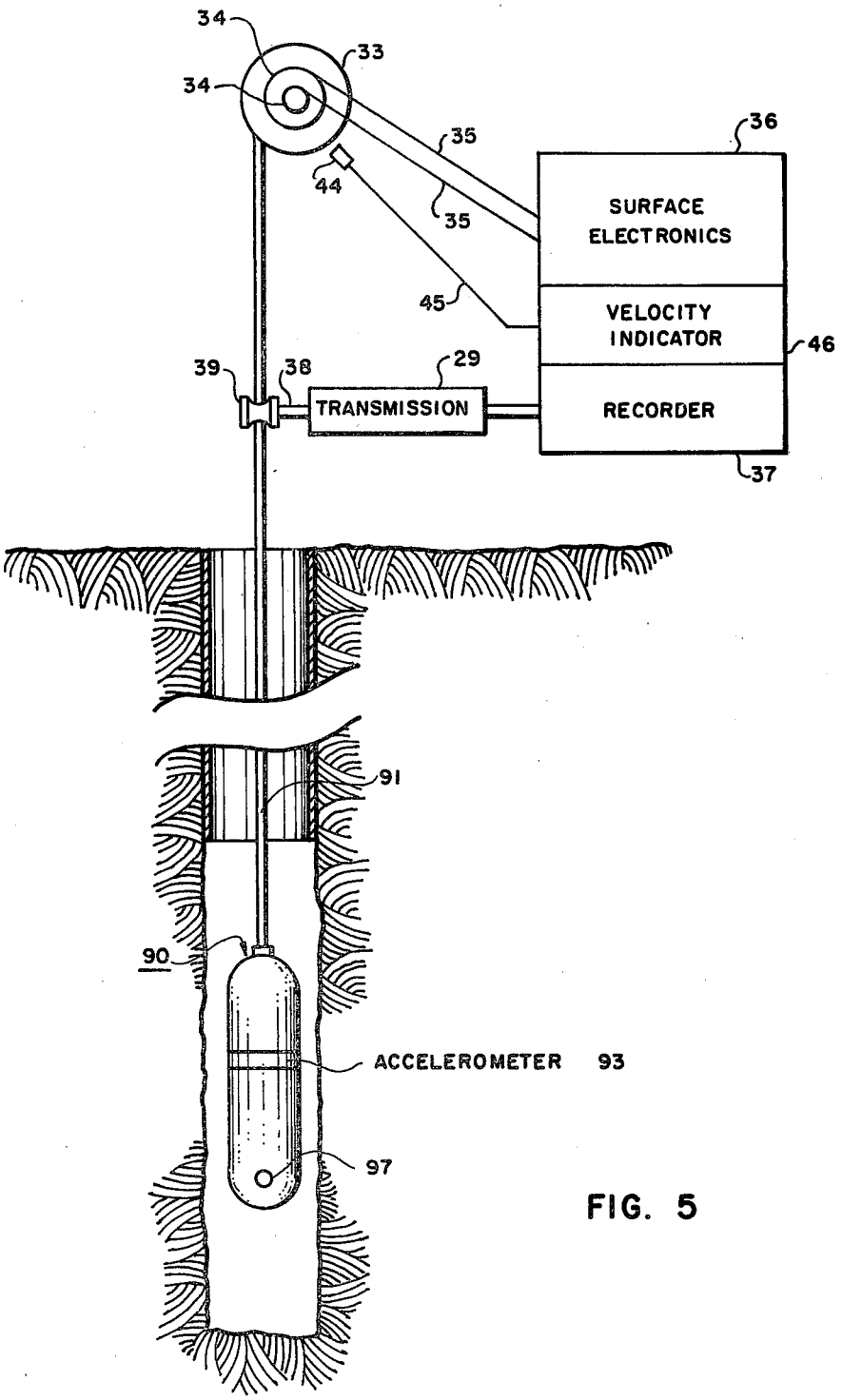
FIG. 5 is an elevated schematic view, partly in block diagram, of the logging system used in accordance with the apparatus according to FIG. 4.

Referring now to FIG. 5, the well logging instrument 90 illustrated in FIG. 4 is shown in elevated view within an earth borehole and is suspended by a well logging cable 91 from the earth's surface and which passes over a measuring sheave 39 to the drum 33 as is illustrated in FIG. 2. However, in addition to the surface apparatus illustrated in FIG. 2, the surface apparatus of FIG. 5 includes a sensor 44 which monitors the velocity of the drum 33 as it rotates as an indication of the velocity of the logging cable 91. The signal from the sensor 44 passes over a conductor 45 to a conventional velocity indicator circuit 46. As was illustrated in FIG. 4, the well logging instrument 90 includes an accelerometer 93 which, together with the signal from the velocity indicator circuit 46 at the surface, controls the fluid which is caused to be ported from the orifice 97 in the lower portion of the well logging instrument 90.

Figure 6:
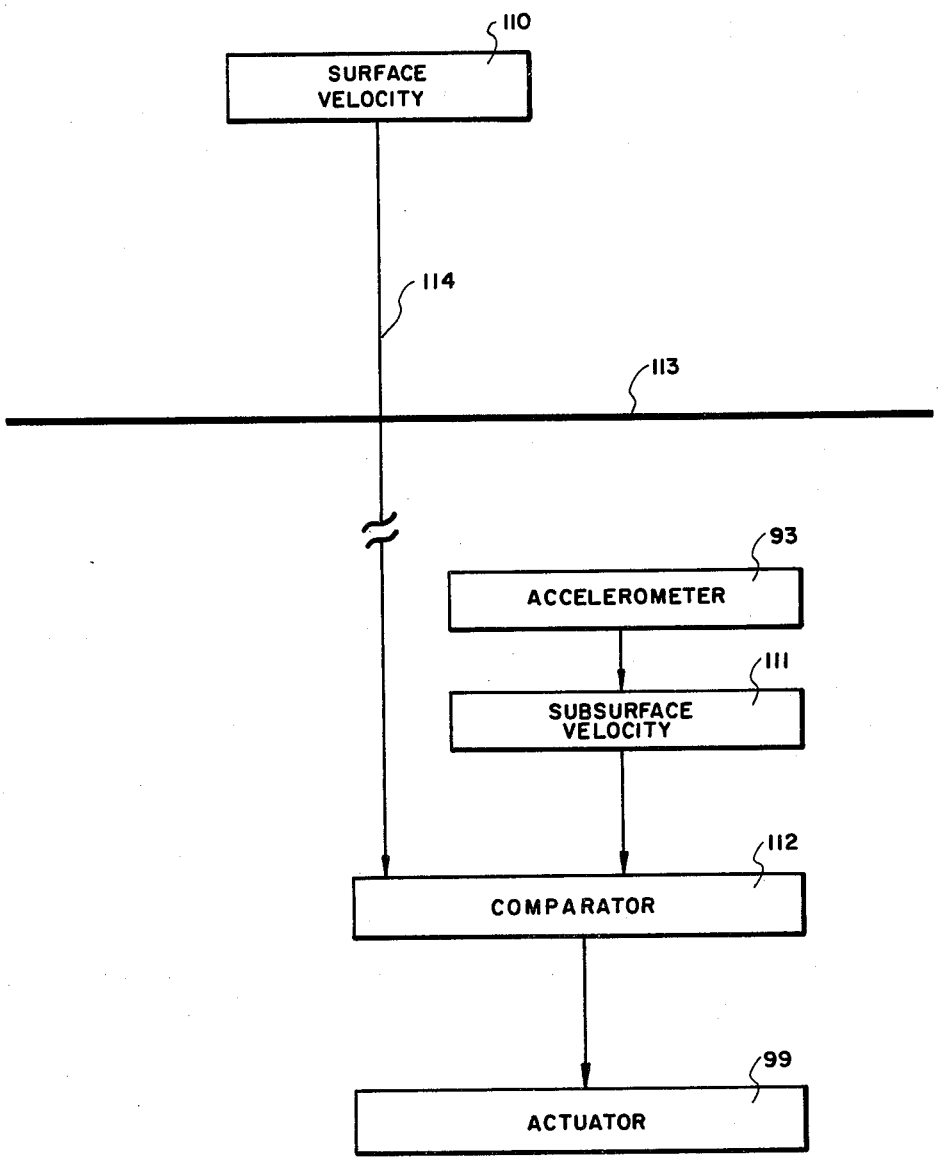
FIG. 6 illustrates in block diagram portions of the functions accomplished by the system illustrated in FIG. 5.

Referring now to FIG. 6, the functions of the apparatus illustrated and described with respect to FIGS. 4 and 5 are shown in block diagram. The block 110 is indicative of a signal relating to the surface velocity of the well logging cable, and this signal is passed along a conductor within the well logging cable, shown generally by the numeral 114, to a comparator circuit 112 which is located within the valve control electronics section 94 in the subsurface instrument 90. The line 113 is functionally related to the separation between the surface electronics and the subsurface electronics. The output from the accelerometer 93 is passed into a conventional velocity circuit 111 which converts the accelerometer signal into a velocity signal in a manner well known in the art. The velocity signal from the subsurface velocity circuit 111 is compared with the surface velocity signal 110 in the comparator circuit 112 and whenever a signal of predetermined magnitude from the comparator circuit 112 exists, a signal is passed to the actuator circuit 99, for example, the valve 99, within the orifice 97 to thereby port the fluid within the chamber 96 into the borehole.

It should be appreciated that when the well logging instrument 90 is being caused to traverse the borehole by means of the cable 91, the well logging cable at the surface will not always be traveling at the exact velocity as that of the borehole instrument. This is caused by various reasons, such as the stretch of the well logging cable and the encounter of the well logging instrument with ledges and other deviated portions within the earth borehole. However, it may not be desirable to actuate the valve 99 upon every minute difference indicated by the comparator 112. Thus, the comparator 112 can be set by means well known in the art to generate a signal to the valve or other actuator means 99 upon the difference between the two velocity signals exceeding some predetermined magnitude, for example, a 5% or 10% difference.

Thus there have been illustrated and described herein the preferred embodiments of the present invention which provide methods and apparatus for injecting a friction-reduction agent into an earth borehole to facilitate the movement of the well logging apparatus through the borehole. However, those skilled in the art will recognize that obvious modifications can be made to the preferred embodiments without departing from the spirit of the invention. For example, instead of using a high molecular weight polymer for the friction-reduction agent, other such well-known friction-reduction agents can be utilized. Furthermore, instead of using a valve dependent upon changes in velocity, other parameters can be measured and the valve or other such device for porting the friction-reduction agent into the borehole can be activated as a response to such parameters or can be activated manually from the earth's surface.

The embodiments of the invention in which an exclusive property or privilege is claimed are defined as follows:

1. An apparatus for logging an earth borehole, comprising an elongated well logging instrument comprised of two sections, the first of said sections comprised of well logging instrumentation, the second of said sections including means to port a friction-reduction agent from said apparatus into said borehole comprising a chamber within said second section for maintaining said friction-reduction agent, and means within said chamber for forcing said friction-reduction agent into the borehole at various points along the length thereof to facilitate movement of said apparatus through the borehole.

2. The apparatus according to claim 1 wherein said means within said chamber comprises a spring-loaded piston pressure-balanced against the pressure of the borehole fluid.

3. The apparatus according to claim 2, being further characterized by at least one valve-controlled fluid orifice between said chamber and the earth borehole.

4. The apparatus according to claim 3, comprising in addition thereto, means to control said valve-controlled fluid orifice.

5. The apparatus according to claim 4, comprising in addition thereto, means for monitoring the velocity of said well logging apparatus, and for controlling said valve-controlled orifice in response to a comparison of said velocity of said apparatus with some other parameter.

6. The apparatus according to claim 5, comprising in addition thereto, a logging cable which suspends the apparatus from the earth's surface, means for measuring the velocity of said cable at the earth's surface, and said other parameter comprises the velocity of said cable at the earth's surface.

7. A method of well logging, comprising the steps of:

causing a well logging instrument to traverse an earth borehole; and porting a friction-reduction agent from said instrument into said borehole in response to the decreased acceleration of said well logging instrument to facilitate the movement of said instrument through said borehole.

8. A method of well logging, comprising the steps of:

causing a well logging instrument to traverse an earth borehole; and porting a friction-reduction agent from said instrument into said borehole in response to the adverse comparison of the velocity of said well logging instrument with the velocity of the well logging cable at the earth's surface to facilitate the movement of said instrument through said borehole.

* * * * *